US010135173B2

(12) United States Patent
Kashiwada

(10) Patent No.: US 10,135,173 B2
(45) Date of Patent: Nov. 20, 2018

(54) COVER UNIT WITH RUBBER PLUG AND CONNECTOR

(71) Applicant: Sumitomo Wiring Systems, Ltd., Yokkaichi, Mie (JP)

(72) Inventor: Tomokazu Kashiwada, Mie (JP)

(73) Assignee: Sumtomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/572,572

(22) PCT Filed: May 23, 2016

(86) PCT No.: PCT/JP2016/065129
§ 371 (c)(1),
(2) Date: Nov. 8, 2017

(87) PCT Pub. No.: WO2016/190267
PCT Pub. Date: Dec. 1, 2016

(65) Prior Publication Data

US 2018/0175537 A1 Jun. 21, 2018

(30) Foreign Application Priority Data

May 28, 2015 (JP) ..... 2015-108324

(51) Int. Cl.
*H01R 13/44* (2006.01)
*H01R 13/52* (2006.01)

(52) U.S. Cl.
CPC ..... *H01R 13/44* (2013.01); *H01R 13/52* (2013.01); *H01R 13/5202* (2013.01)

(58) Field of Classification Search
CPC ..... H01R 13/44; H01R 13/5202; H01R 13/5205; H01R 13/521; H01R 13/5213; H01R 13/5219
(Continued)

(56) References Cited

U.S. PATENT DOCUMENTS 5,551,892 A 9/1996 Endo et al.
5,895,290 A * 4/1999 Self, Jr. ..... H01R 13/5208 439/556
(Continued)

FOREIGN PATENT DOCUMENTS

| | | |
|---|---|---|
| JP | 7-122331 | 5/1995 |
| JP | 2015-082465 | 4/2015 |
| WO | 2014/069285 | 5/2014 |

OTHER PUBLICATIONS

International Search Report dated Aug. 9, 2016.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A rubber plug assembly (40) includes a rubber plug (50) with a shaft (51) and waterproofs the interior of a housing (20). Legs (52) extend out in a radial direction from an axial end (51A) of the shaft (51). Recesses are in the legs (52) and are long in the radial direction. A cover (70) is to be fixed to the housing (20). A rubber plug holder (60) includes assembling holes (65) for allowing the legs (52) oriented in an axial direction to be inserted therein by resiliently deforming parts of the legs (52) and projections (66) for positioning the rubber plug (50) by being fit into the recesses as the legs (52) that have passed through the assembling holes (65) return. The projections (66) and the recesses are held in a fit state by fixing the rubber plug holder (60) to the cover (70).

3 Claims, 16 Drawing Sheets

(58) Field of Classification Search
USPC ..... 439/587
See application file for complete search history.

(56) References Cited

U.S. PATENT DOCUMENTS

| | | | | |
|---|---|---|---|---|
| 6,383,021 | B1 * | 5/2002 | Murakami | H01R 13/5208 439/489 |
| 6,953,357 | B2 * | 10/2005 | Fukushima | H01R 13/5219 439/271 |
| 8,610,005 | B2 * | 12/2013 | Iida | B60R 16/0239 174/520 |
| 9,705,236 | B2 * | 7/2017 | Horiuchi | H01R 13/5219 |
| 2002/0052140 | A1 * | 5/2002 | Hara | H01R 13/521 439/587 |
| 2015/0029067 | A1 | 1/2015 | Pang et al. | |
| 2018/0126929 | A1 * | 5/2018 | Miller | B60R 16/0222 |
| 2018/0131118 | A1 * | 5/2018 | Kashiwada | H01R 13/5205 |
| 2018/0159263 | A1 * | 6/2018 | Kashiwada | H01R 13/44 |

* cited by examiner

COVER UNIT WITH RUBBER PLUG AND CONNECTOR

BACKGROUND

Field of the Invention

This specification relates to a rubber plug assembly.

Description of the Related Art

Japanese Unexamined Patent Publication No. 2015-82465 discloses a connector to be connected to a large-current cable. This connector includes a housing that can fit into a mounting hole in a casing of a device. The inside of the housing includes a device-side terminal to be connected to a mating terminal, a wire-side terminal connected to a core of a wire, and a connecting member that connects the device-side terminal and the wire-side terminal. Voltage detection holes are open in an upper part of the housing and expose a connecting part of a connection terminal and the wire-side terminal. The voltage detection holes correspond to a positive electrode and a negative electrode for enabling respective lead rods of a tester to contact the connecting part of the connection terminal and the wire-side terminal to confirm that the connecting part of the connection terminal and the wire-side terminal are not charged.

Sealing plug bodies made of rubber are fit tightly into the voltage detection holes to seal the interior of the housing. The sealing plug bodies are mounted on a voltage detection cover to be attached to the upper part of the housing.

The sealing plug body described above may be mounted on the voltage detection cover using a resin component called a rubber plug holder. The sealing plug body is made of rubber and is not as hard as the resin component. Thus, the sealing plug body is detached easily and is difficult to position even if being directly mounted on the voltage detection cover. These problems can be solved by using a resin holder. However, to assemble a rubber component such as the sealing plug body with the resin component, it is necessary to forcibly deform and pull the rubber component. Therefore a degree of difficulty in assembling is high.

SUMMARY

A rubber plug assembly disclosed by this specification is provided with a rubber plug including a shaft for waterproofing the interior of a housing and a leg extending radially out from an axial end part of the shaft. A recess is provided in the leg and is long in the radial direction. The rubber plug assembly further has a cover to be fixed to the housing, and a rubber plug holder including an assembling hole for allowing the leg oriented to extend in the axial direction to be inserted therein by resiliently deforming a part of the leg and a projection for positioning the rubber plug by being fit into the recess by a return of the leg that has passed through the assembling hole. The projection and the recess are held in a fit state by fixing the rubber plug holder to the cover.

According to this configuration, the recess of the leg long in the radial direction. Thus, the peripheral wall of the recess will not interfere with the projection to obstruct a returning movement of the leg when the leg returns and the recess is fit to the projection. Specifically, since the recess can be fit to the projection only by a reaction force (force trying to return to a natural state) of the rubber plug, it is not necessary to fit the recess to the projection by forcibly deforming or pulling the leg and assembling efficiency can be improved drastically improved.

A tapered portion may be provided between a locking portion of the projection facing an inner wall of the recess and the assembling hole and may be configured not to obstruct a returning movement of the leg. According to this configuration, there is nothing that obstructs the returning movement of the leg until the leg contacts the tapered portion after being inserted into the assembling hole, and the leg is in an open state when contacting the tapered portion. Thus, the reaction force of the rubber plug easily acts in a direction to assemble the rubber plug with the rubber plug holder.

The projection may be tapered by a plurality of the tapered portions. According to this configuration, the projection is fit easily into the recess.

According to the rubber plug assembly disclosed by this specification, it is possible to improve assembling efficiency in assembling the rubber plug with the rubber plug holder.

DETAILED DESCRIPTION

Figure 1:
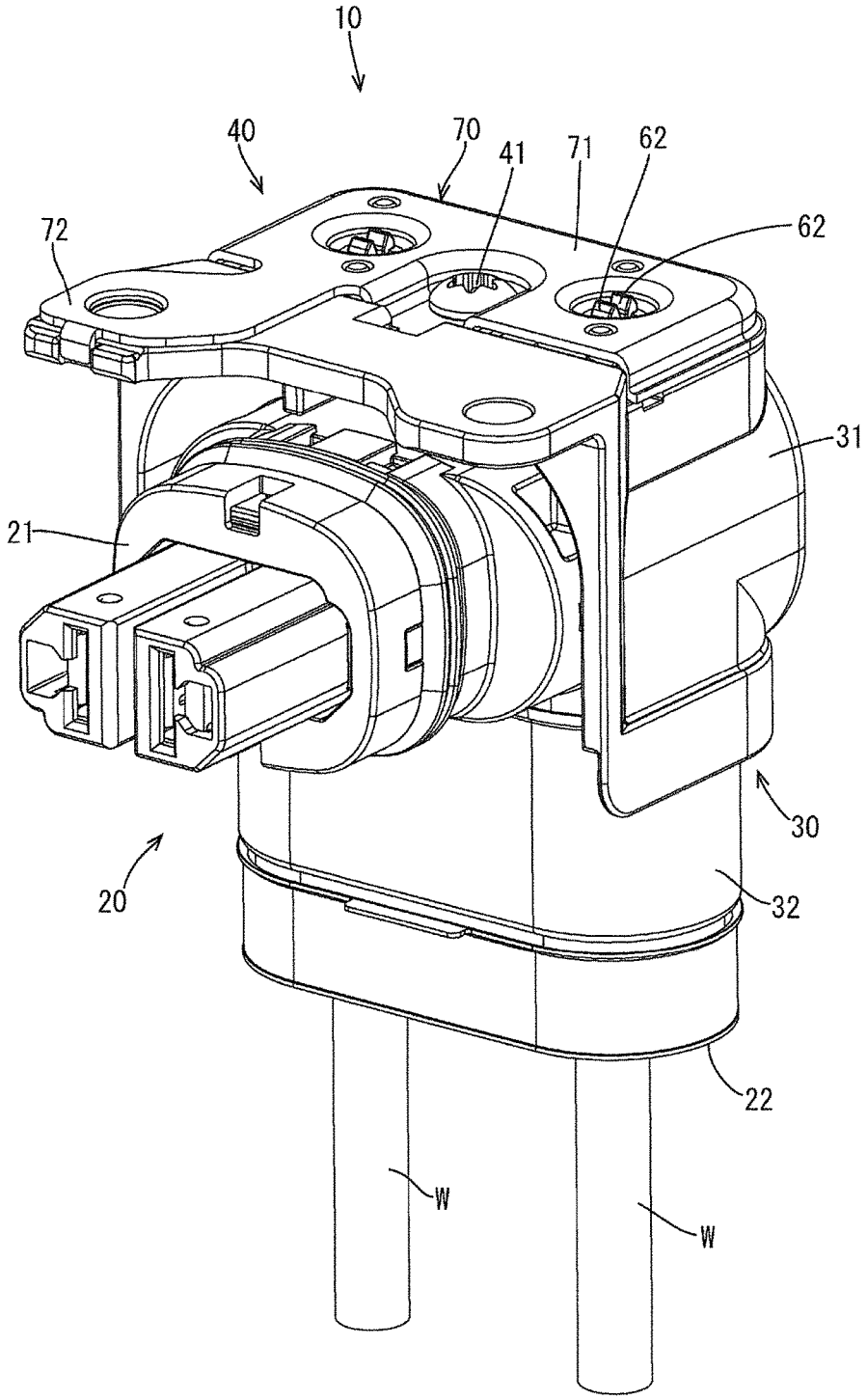
FIG. 1 is a perspective view of a connector in an embodiment.

An embodiment is described with reference to FIGS. 1 to 16. A connector 10 of this embodiment includes a housing 20 made of synthetic resin and a shield shell 30 made of metal for covering the housing 20, as shown in FIG. 1. The housing 20 is substantially L-shaped and includes a connector fitting portion 21 that projects forward and a wire pull-out portion 22 from which wires W are pulled out downwardly. The connector fitting portion 21 is fittable into a mounting hole provided in a casing of an unillustrated device. The shield shell 30 includes an upper shell 31 for covering the connector fitting portion 21 and a lower shell 32 for covering the wire pull-out portion 22.

Figure 2:
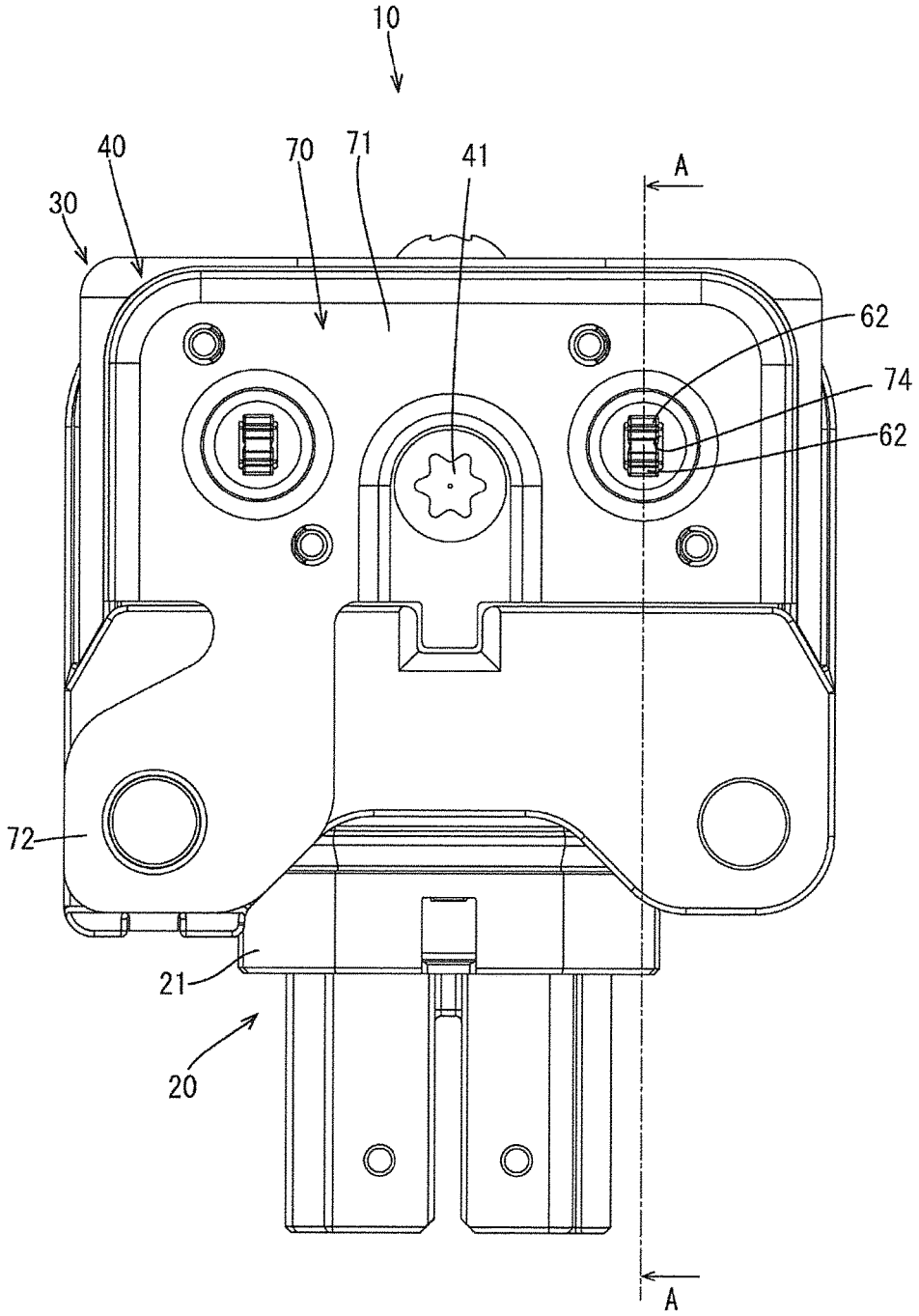
FIG. 2 is a plan view of the connector.
Figure 4:
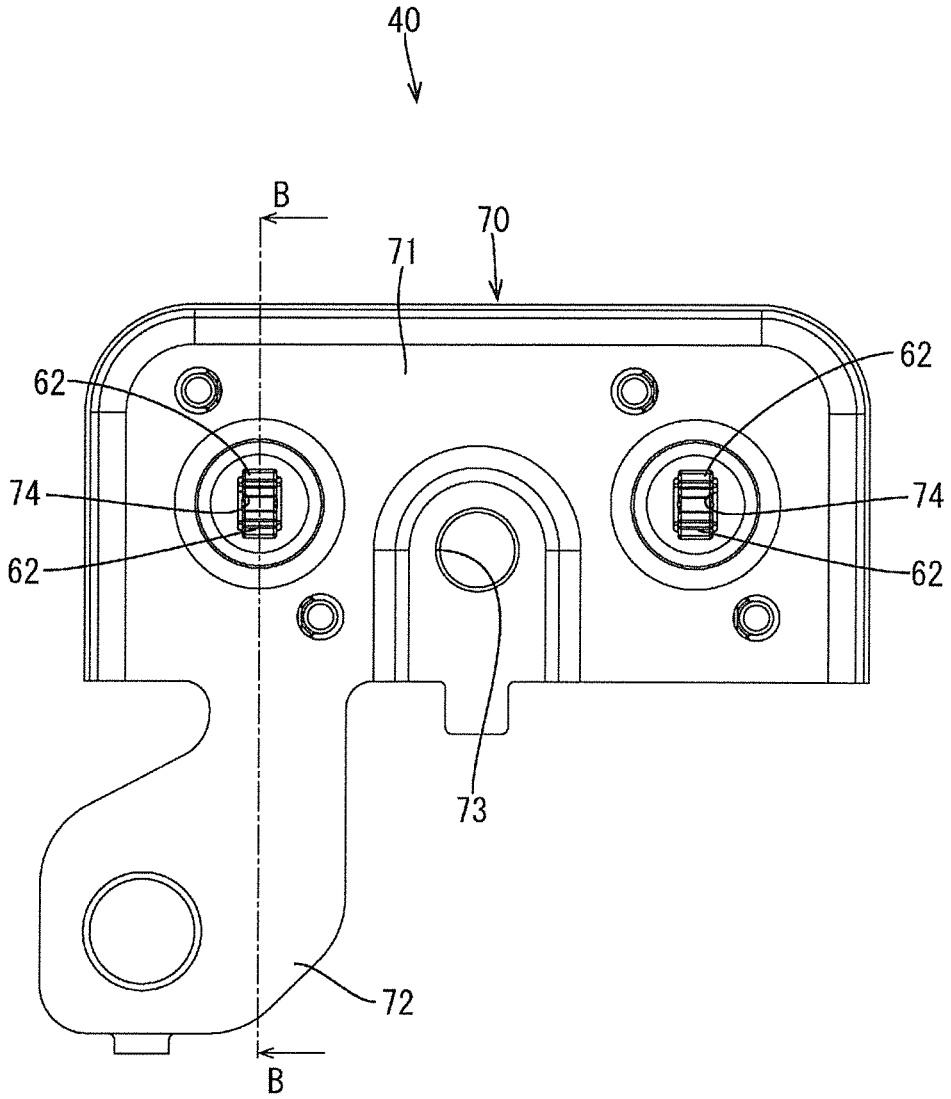
FIG. 4 is a plan view of a rubber plug assembly.
Figure 5:
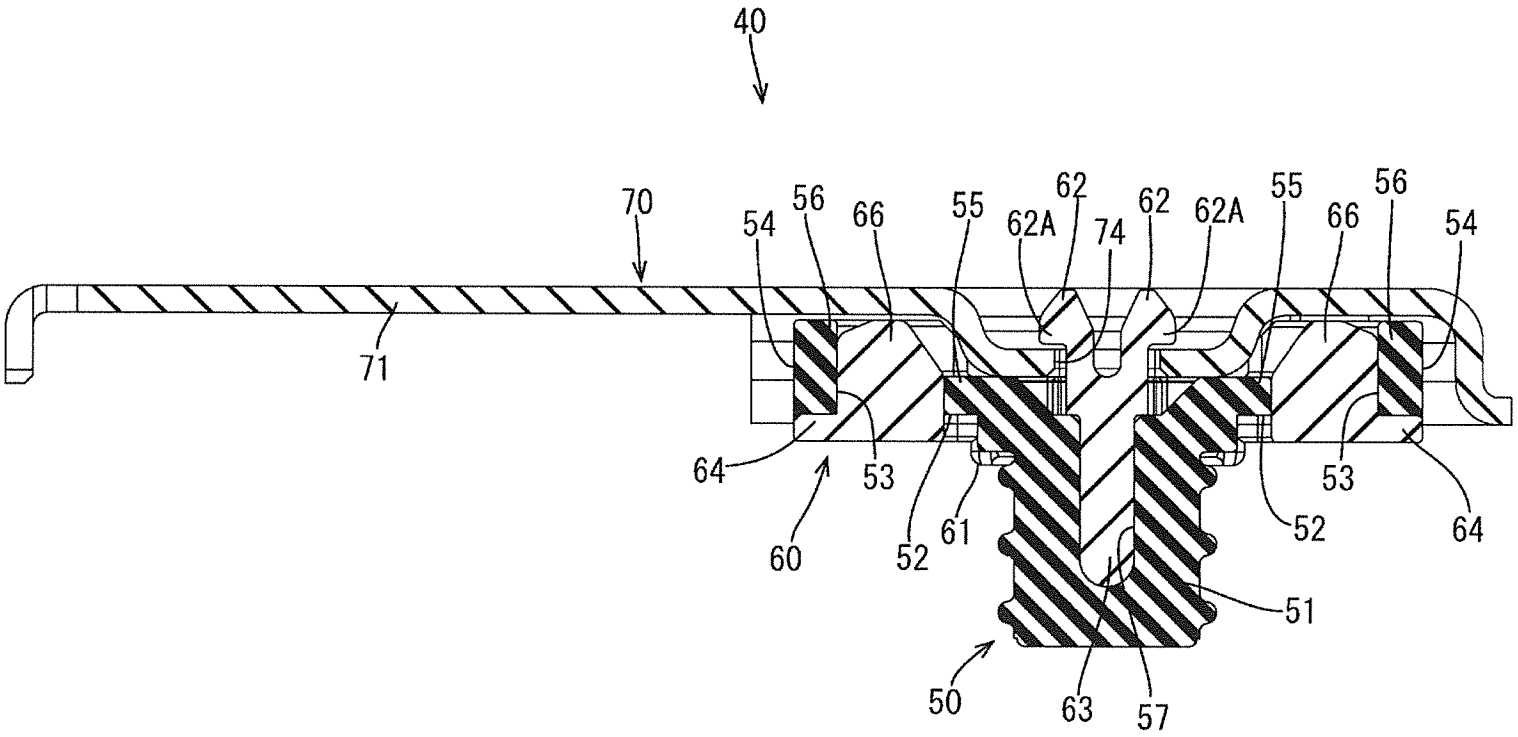
FIG. 5 is a section along B-B in FIG. 4.

A rubber plug assembly 40 is attached to an upper part of the upper shell 31. As shown in FIGS. 4 and 5, the rubber plug assembly 40 is formed by integrally assembling rubber plugs 50, rubber plug holders 60 made of synthetic resin and a cover 70 made of metal. One rubber plug 50 and one rubber plug holder 60 are disposed on each of the left and right sides of the cover 70. As shown in FIG. 2, the rubber plug assembly 40 is attached by fastening a bolt 41 to an unillustrated nut fixed to the housing 20.

Figure 3:
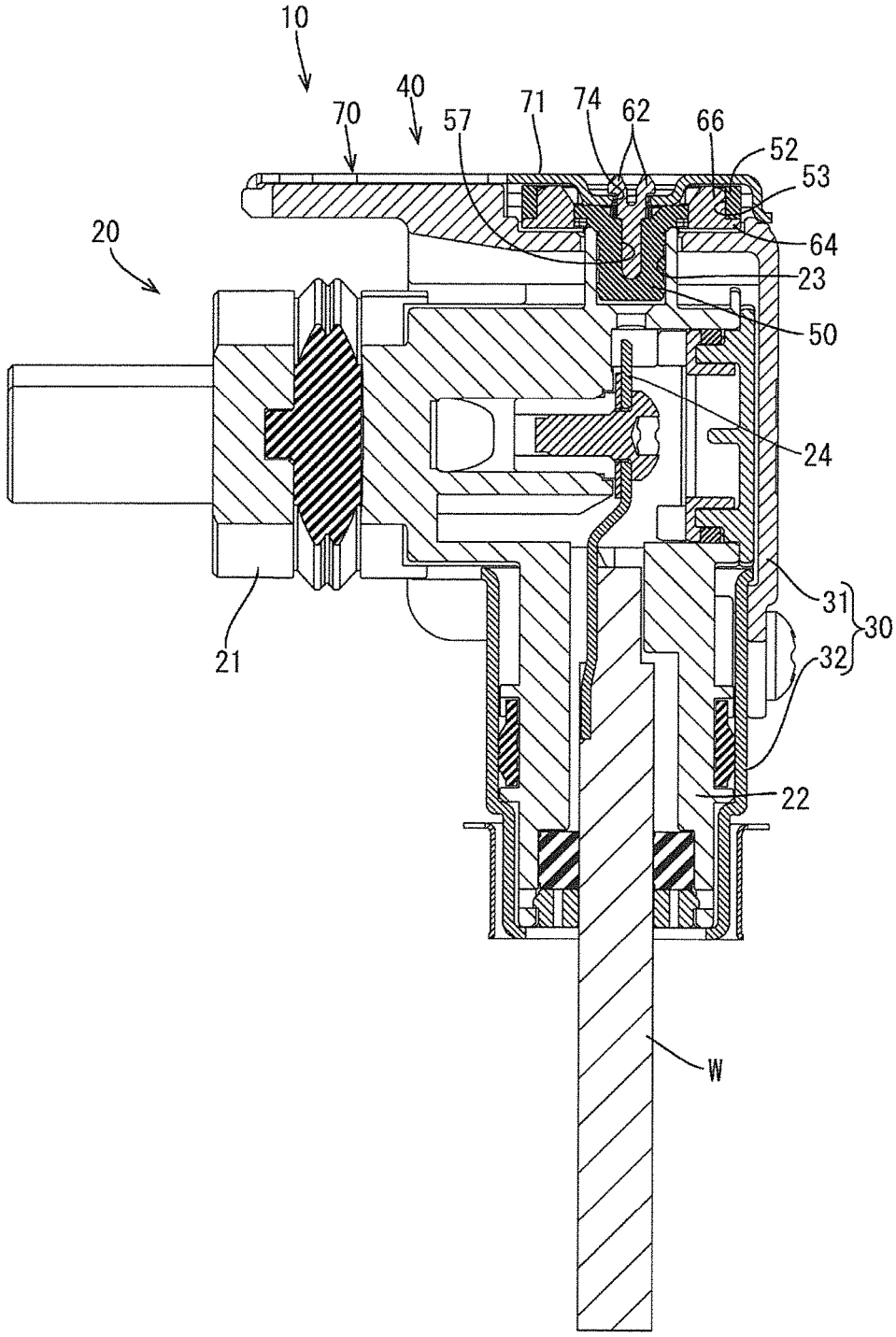
FIG. 3 is a section along A-A in FIG. 2.

As shown in FIG. 3, a voltage detection hole 23 is open in the upper surface part of the housing 20, and a wire-side terminal 24 connected to the wire W is disposed below this voltage detection hole 23. Thus, whether or not the wire-side terminal 24 is charged can be confirmed by inserting a lead rod of a tester through the voltage detection hole 23 and bringing the lead rod into contact with the wire-side terminal 24. The interior of the housing 20 can be waterproofed by fitting the rubber plug 50 into the voltage detection hole 23.

Figure 6:
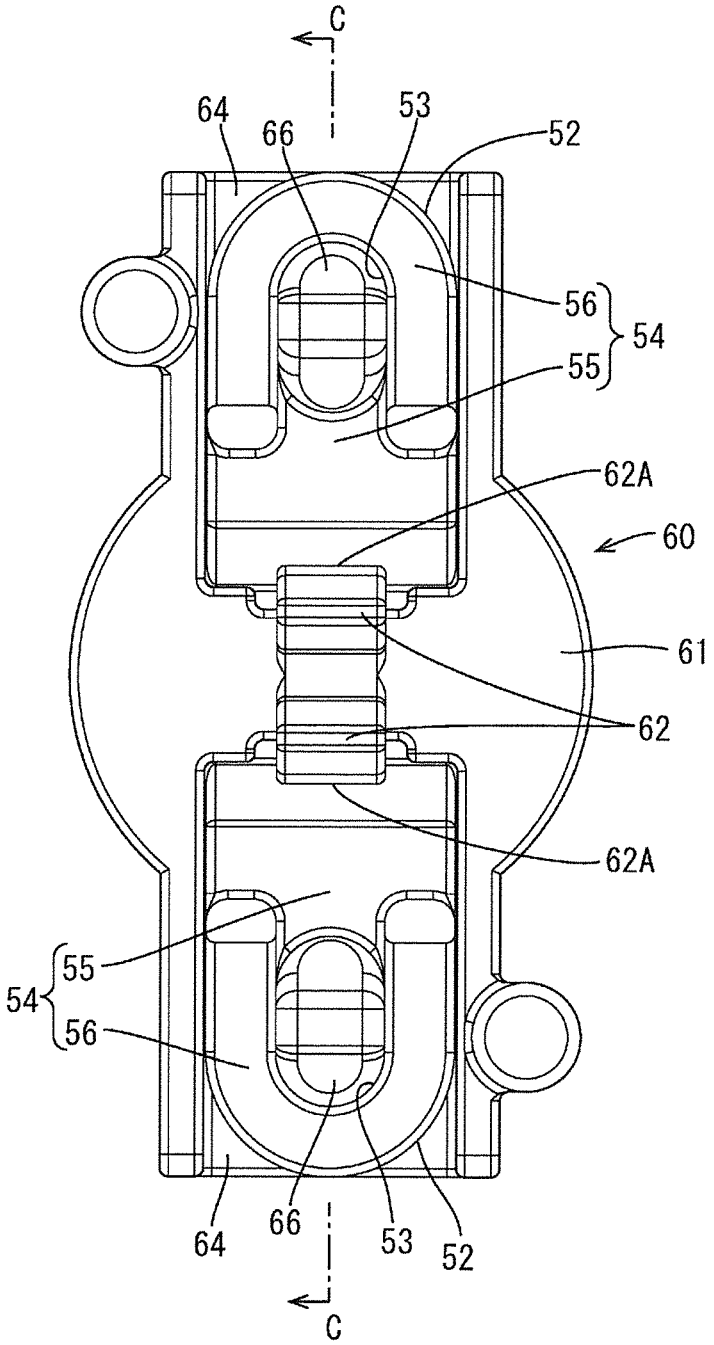
FIG. 6 is a plan view of a rubber plug assembled with a rubber plug holder.
Figure 10:
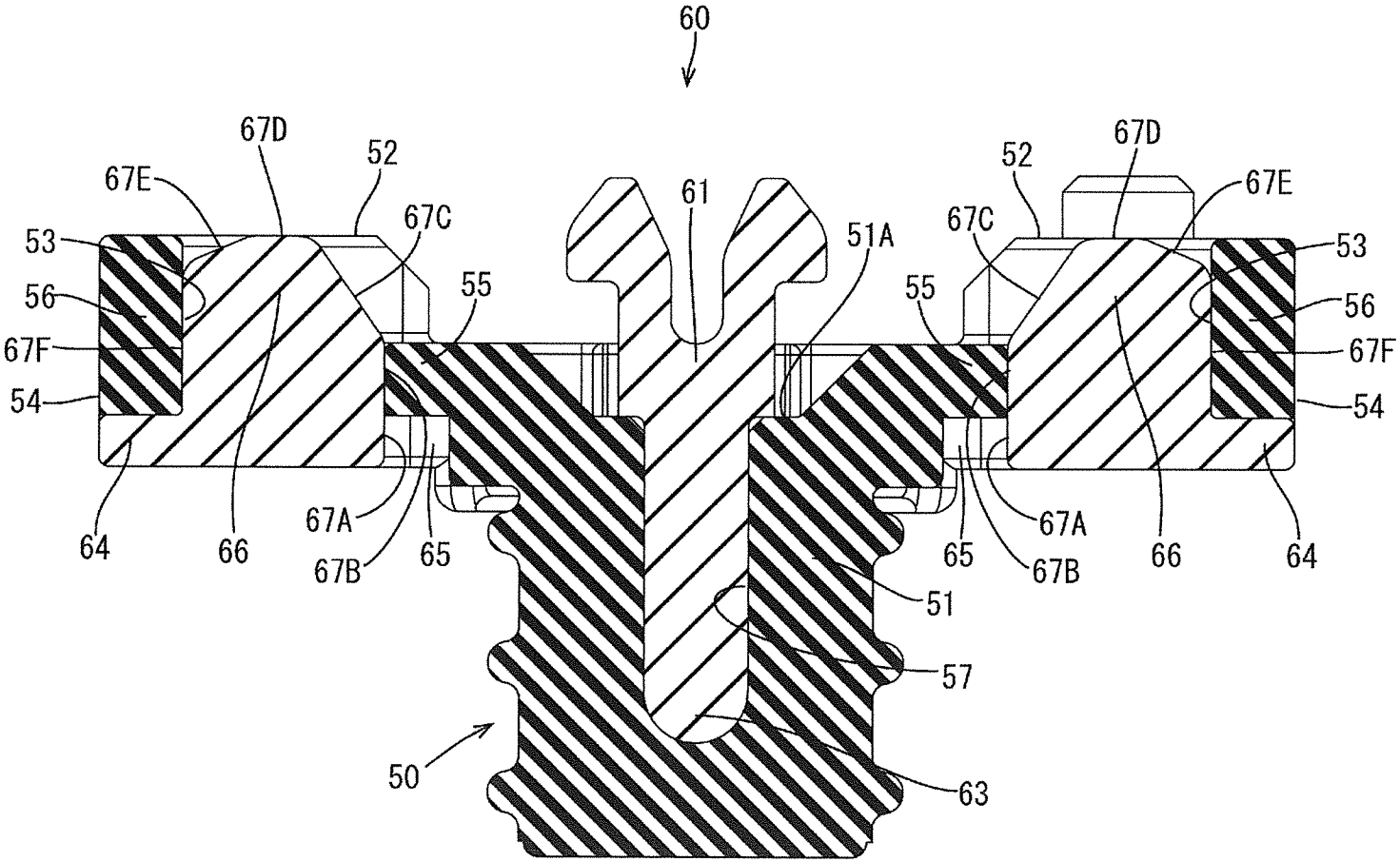
FIG. 10 is a section along C-C in FIG. 6.
Figure 14:
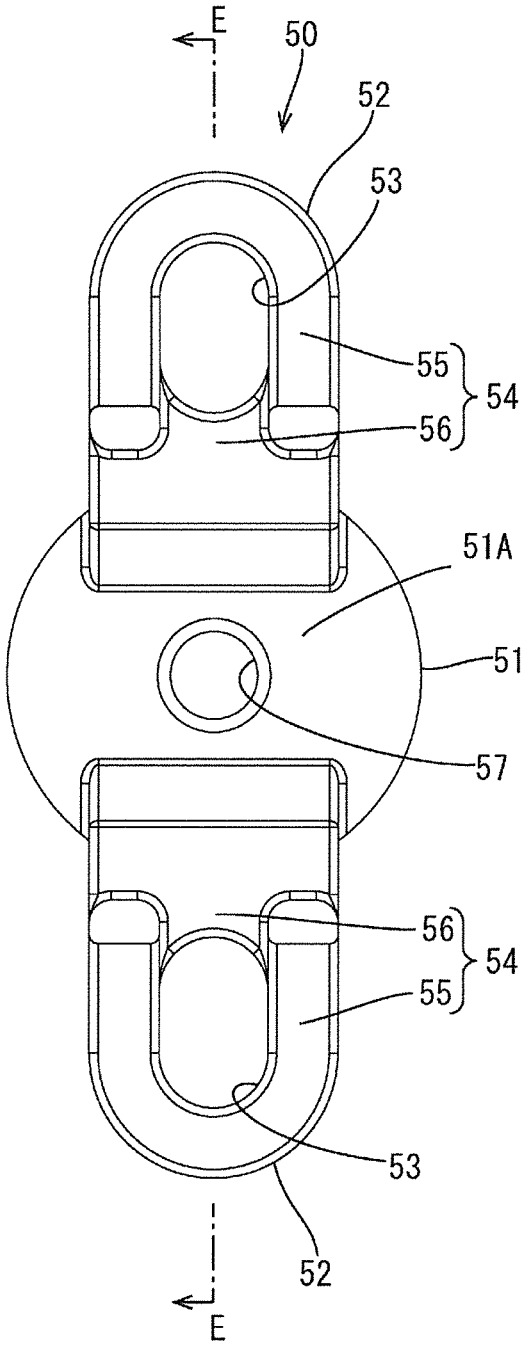
FIG. 14 is a plan view of the rubber plug.
Figure 15:
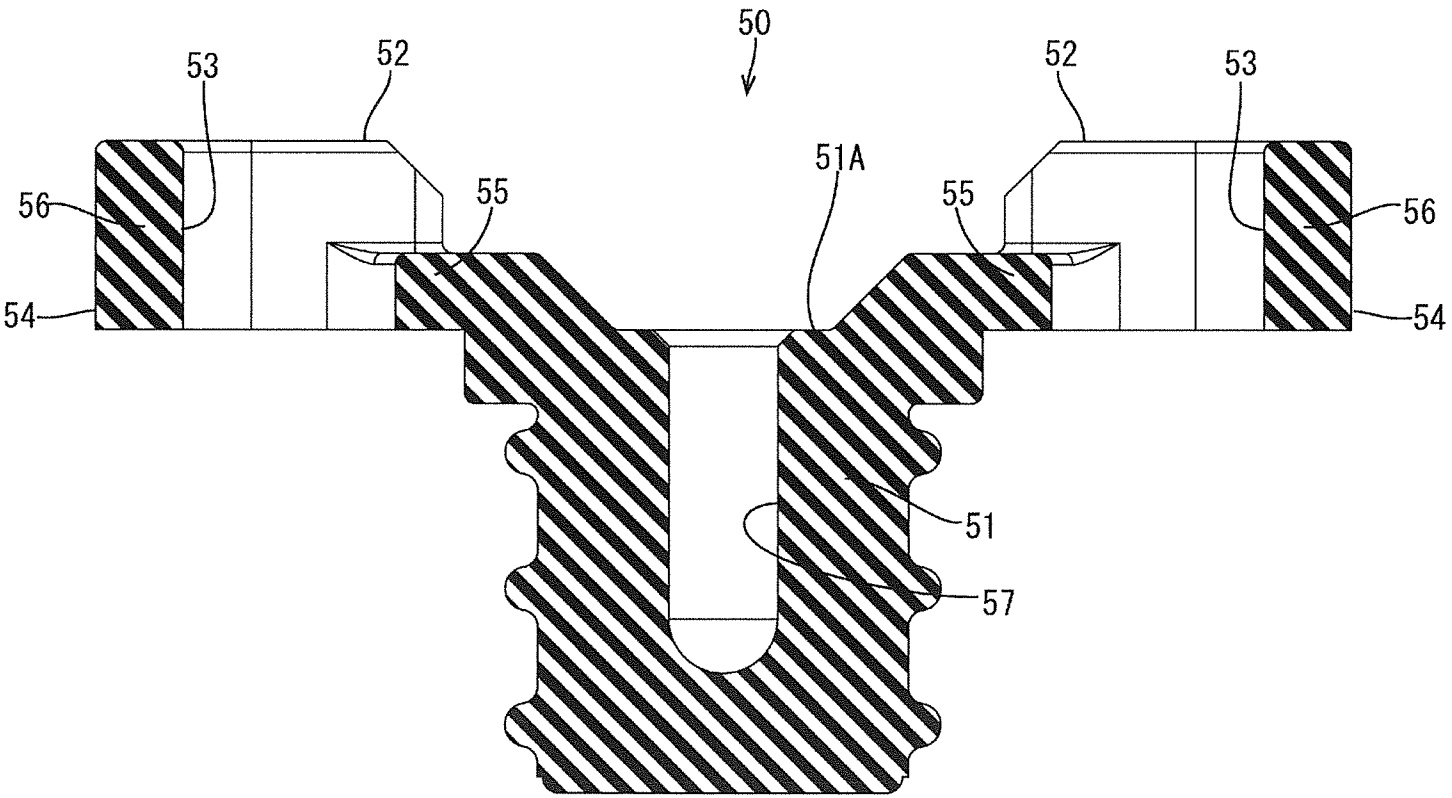
FIG. 15 is a section along E-E in FIG. 14.

Specifically, as shown in FIG. 10, the rubber plug 50 includes a cylindrical shaft 51 and two legs 52 projecting radially outward from an axial end part 51A of the shaft 51. The leg 52 is provided with a through hole 53. This through hole 53 is a closed hole and has an elliptical cross-section that is long in a radial direction of the shaft 51, as shown in FIG. 14. A peripheral wall 54 of the through hole 53 is continuous without interruption, as shown in FIG. 6. The peripheral wall 54 is composed of a thin portion 55 connected to the shaft 51 and a thick portion 56 located radially out of the thin portion 55 to define a U-shape in a plan view. A bottomed attachment hole 57 is provided inside the shaft 51 and is open on the side of the axial end part 51A.

Figure 12:
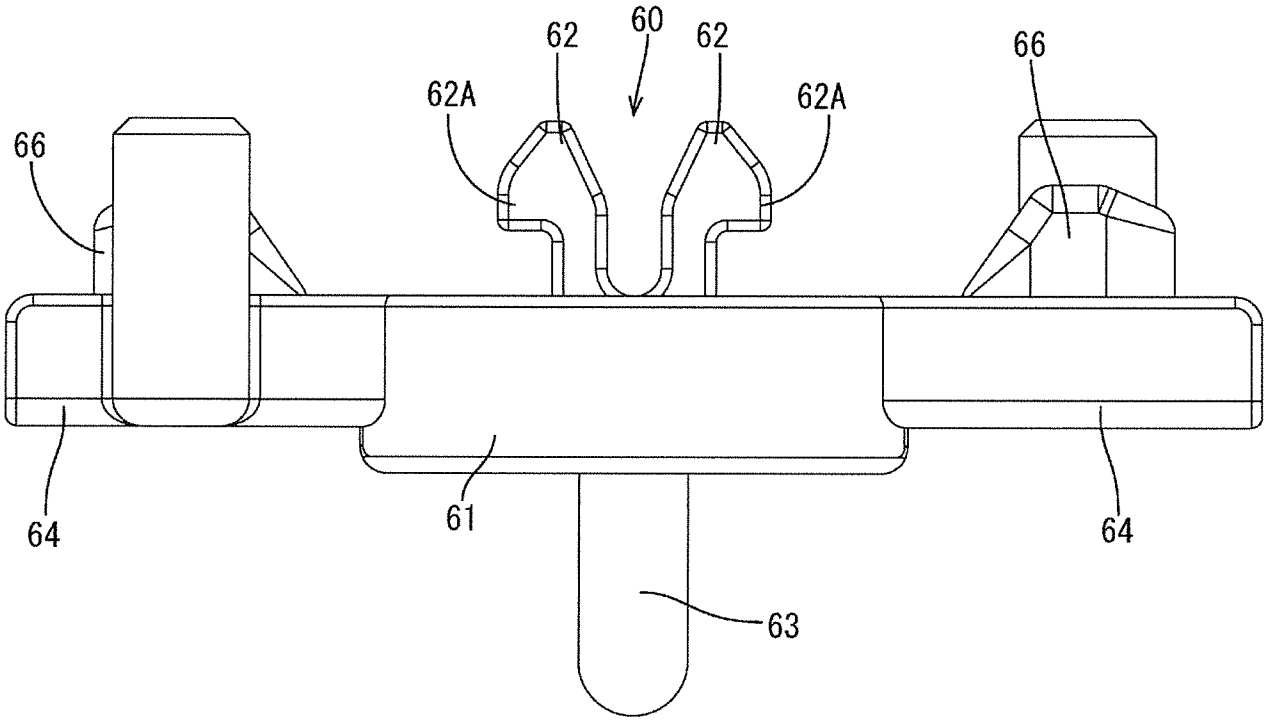
FIG. 12 is a side view of the rubber plug holder.

As shown in FIG. 12, the rubber plug holder 60 includes a holder body 61 to which the shaft 51 of the rubber plug 50 is to be attached, and two rubber plug fixing portions 64 disposed on both sides of the holder body 61. The holder body 61 is provided with two lock pieces 62 projecting up and an attachment pin 63 projecting down. The respective lock pieces 62 are resiliently deformable and movable in directions toward and away from each other. Two lock projections 62A facing in opposite directions are provided respectively on tip parts of the lock pieces 62.

Figure 11:
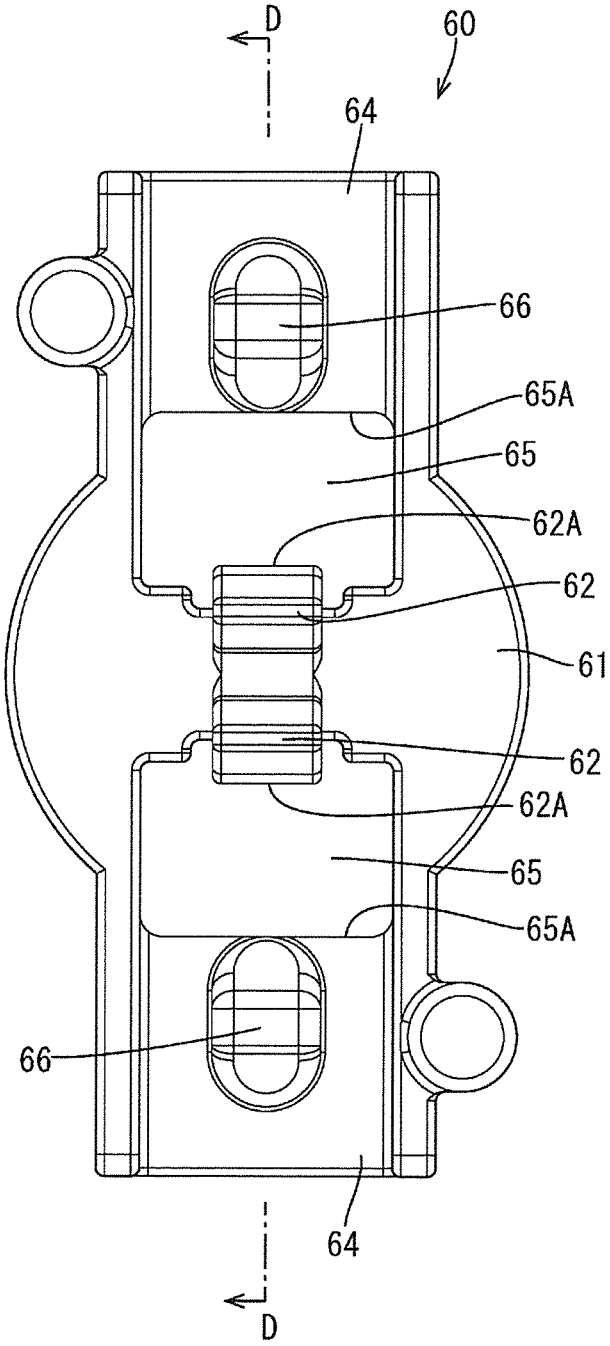
FIG. 11 is a plan view of the rubber plug holder.
Figure 13:
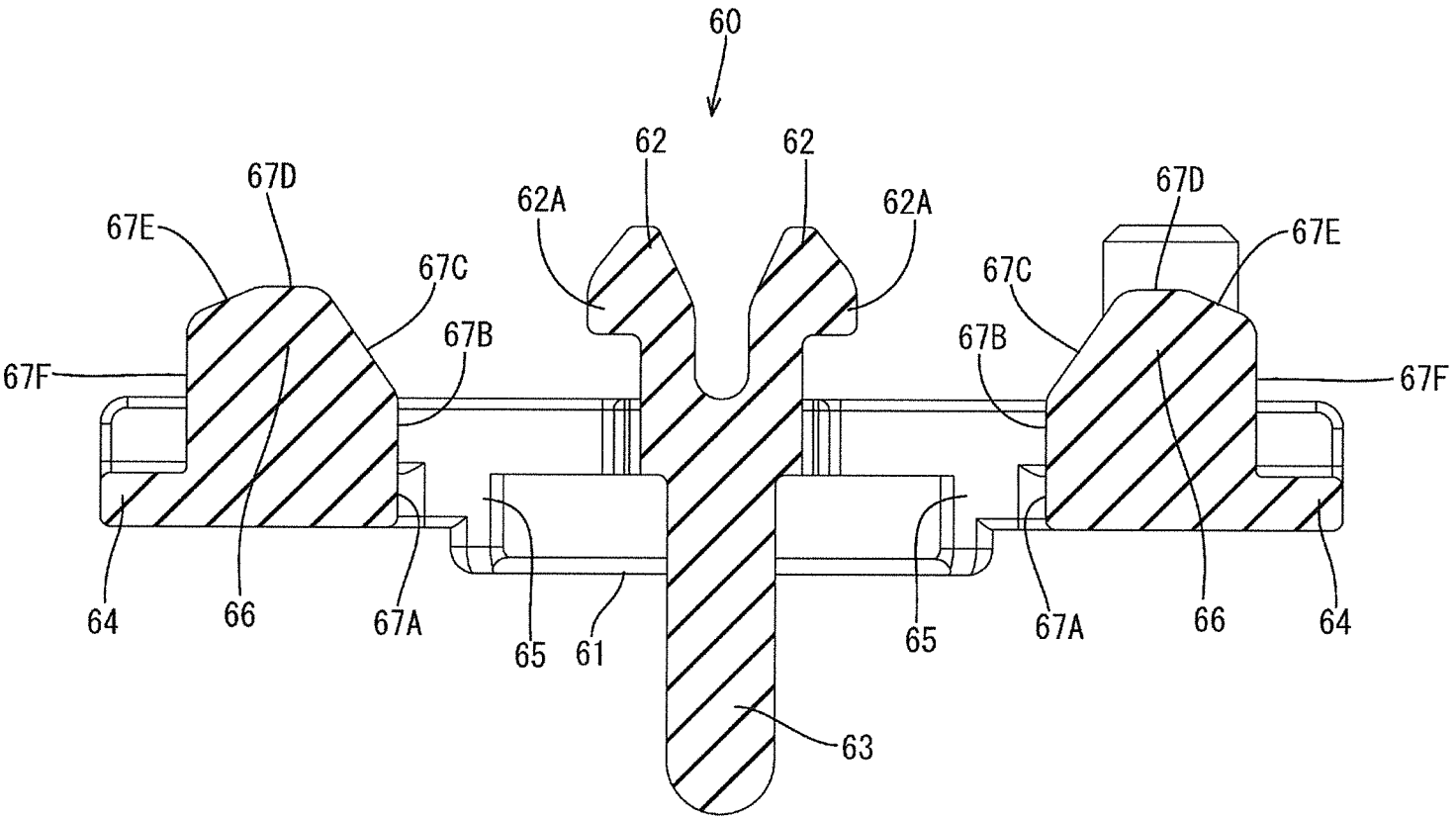
FIG. 13 is a section along D-D in FIG. 11.

As shown in FIG. 11, the holder body 61 has a substantially circular outer peripheral shape and two assembling holes 65 are provided between the rubber plug fixing portions 64 and the respective lock pieces 62. The rubber plug 50 can be assembled with the rubber plug holder 60 by allowing the respective legs 52 of the rubber plug 50 to be inserted therein. Two projections 66 are provided in central parts of the respective rubber plug fixing portions 64. Each projection 66 is arranged to be connected to the assembling hole 65 in a plan view. As shown in FIG. 13, a first introducing portion 67A is located on a side opposite to the lock piece 62 and extends in a vertical direction out of an inner wall of the assembling hole 65. A second introducing portion 67B extends in the vertical direction while facing the lock piece 62 out of the projection 66. The first and second introducing portions 67A and 67B are flush with each other and arranged one above the other in the vertical direction.

Specifically, the projection 66 includes the second introducing portion 67B described above, a first tapered portion 67C extending obliquely up (direction toward an upper side away from the lock piece 62) from the upper edge of the second introducing portion 67B, a planar portion 67D extending radially out from an extending end part of the first tapered portion 67C, a second tapered portion 67E extending obliquely down (direction toward a lower side away from the lock piece 62) from an extending end part of the planar portion 67D and a locking portion 67F extending down from an extending end part of the second tapered portion 67E.

Figure 7:
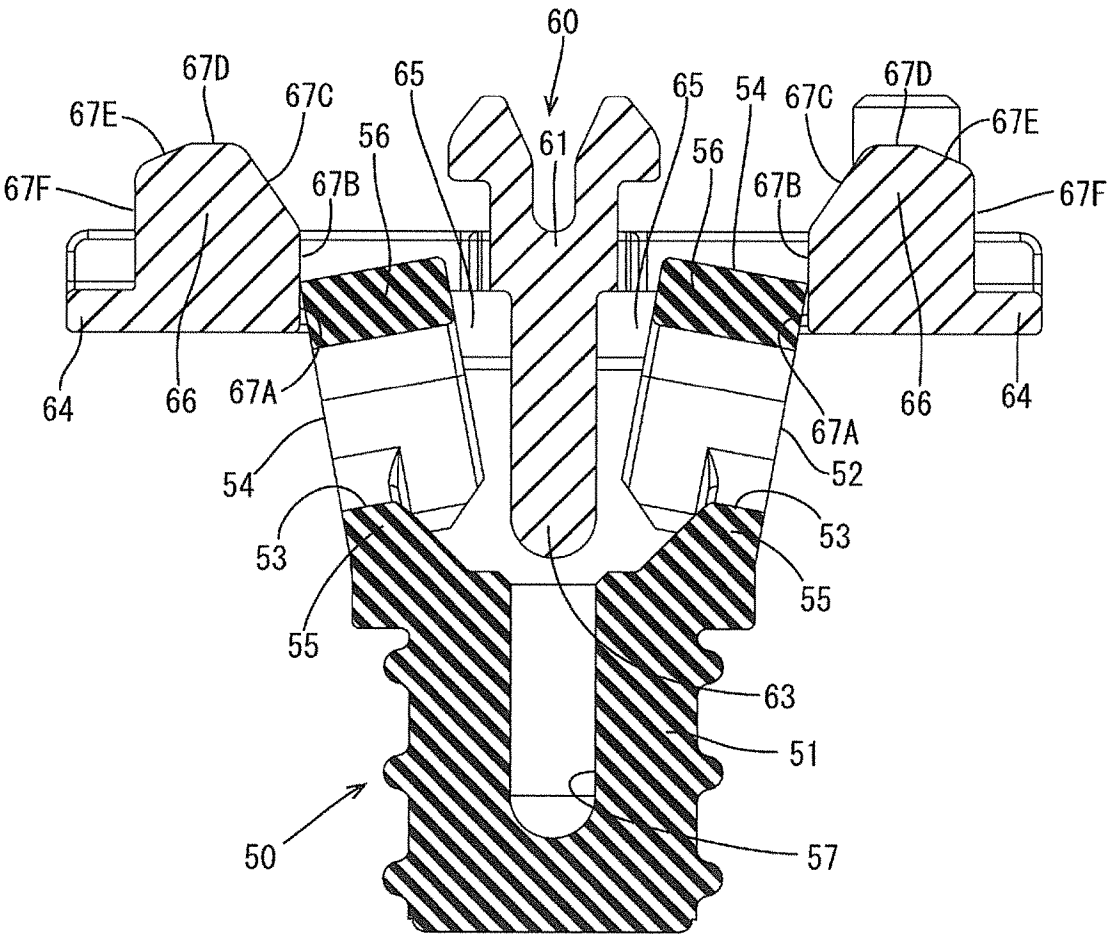
FIG. 7 is a section showing a state where thick portions of leg portions are accommodated in assembling holes.
Figure 8:
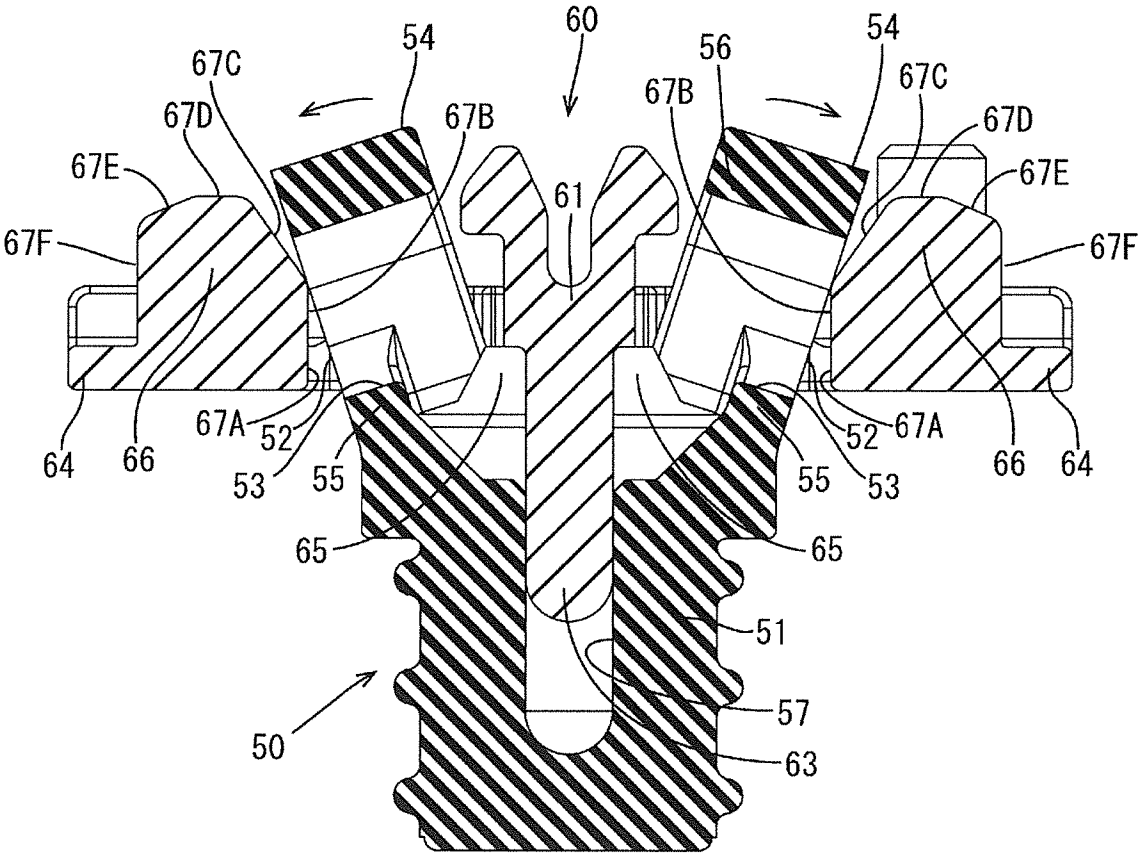
FIG. 8 is a section showing a state where the thick portions of the leg portions are in contact with lower end parts of tapered portions.

To assemble the rubber plug 50 with the rubber plug holder 60, the rubber plug 50 is pinched from both sides by fingers to resiliently deform the respective thin portions 55, as shown in FIG. 7. Thus the legs 52 are oriented to extend in an axial direction and are inserted into the corresponding assembling holes 65 from below in this posture. When the thick portions 56 of the legs 52 reach the first tapered portions 67C from the first introducing portions 67A through the second introducing portions 67B, the thick portions 56 are in contact with the lower end parts of the first tapered portions 67C, as shown in FIG. 8. In this state, a part of the attachment pin 63 is fit in the attachment hole 57.

Figure 9:
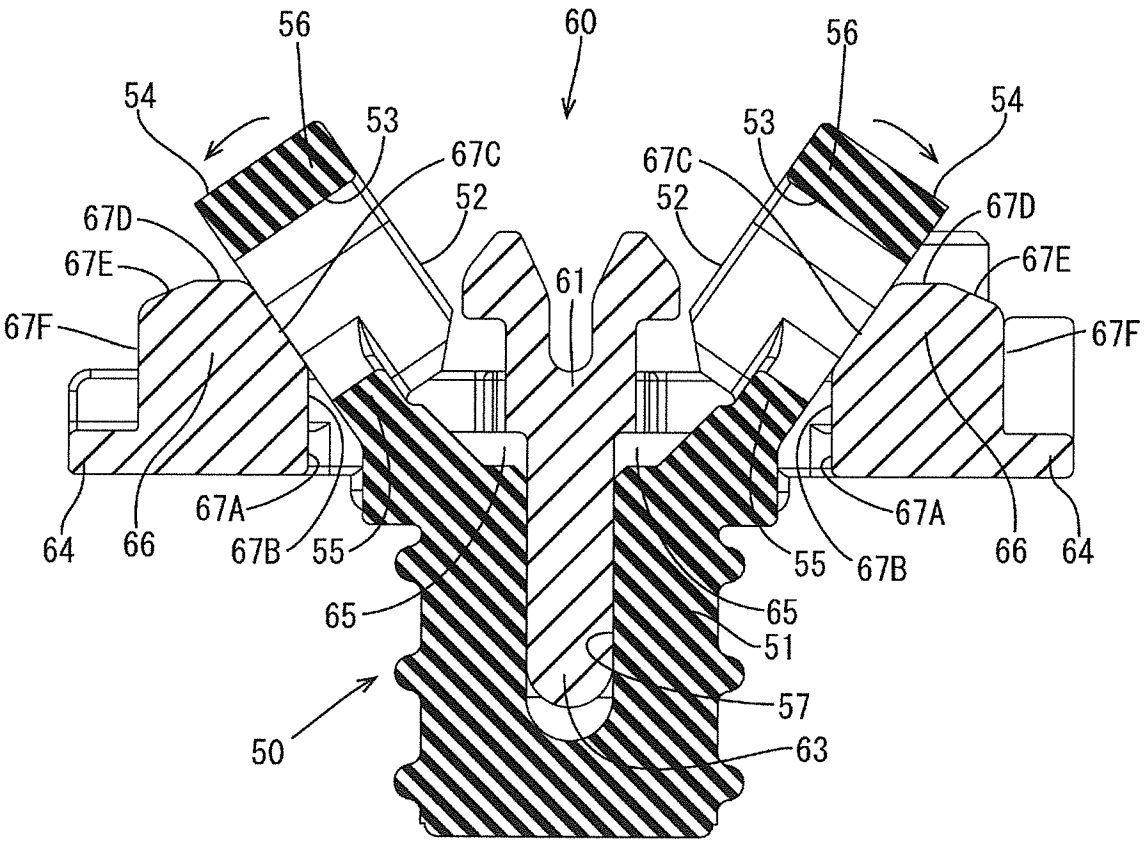
FIG. 9 is a section showing a state where the thick portions of the leg portions are in contact with upper end parts of the tapered portions.

Subsequently, the fingers are released from the rubber plug 50. As a result, the respective legs 52 move in the direction of the arrow in FIG. 8 merely by a reaction force (force trying to return to a natural state) of the rubber plug 50. In this way, the respective legs 52 act to pull up the thin portions 55 and the shaft 51 with the lower ends of the first tapered portions 67C as supports. Then, as shown in FIG. 9, the attachment pin 63 is fit farther into the attachment hole 57 and the thick portions 56 move onto the first tapered portions 67C. The respective legs 52 continue to move in directions of the arrow in FIG. 9, thereby acting to pull up the thin portions 55 and the shaft 51 with the upper end parts of the first tapered portions 67C as supports. At this time, the legs 52 are substantially in an open state. Thus, the reaction force of the rubber plug 50 directly acts to fit the projections 66 into the through holes 53 and the attachment pin 63 is fit into the attachment hole 57 as a reflex action.

Subsequently, the tips of the thick portions 56 pass over the planar portions 67D and the second tapered portions 67E. As a result, the legs 52 smoothly return without being obstructed. At the same time as the attachment pin 63 is fit properly into the attachment hole 57, as shown in FIG. 10, the projections 66 are fit into the through holes 53 of the legs 52 from below. As just described, it is not necessary to push the projections 66 into the through holes 53 by pulling the legs 52 with fingers or deforming the peripheral walls 54 until the assembling of the rubber plug 50 is completed after the fingers are released from the rubber plug 50, and a series of operations are performed automatically merely by the reaction force of the rubber plug 50.

The attachment pin 63 is somewhat press-fit in the attachment hole 57. Thus, the rigidity of the shaft 51 is enhanced by the attachment pin 63 and sealability for the voltage detection hole 23 also is enhanced. On the other hand, each projection 66 is aligned substantially with and fit into each through hole 53. Additionally, the upper end of each projection 66 and that of the thick portion 56 of each peripheral wall 54 are disposed at the same height. Further, each thick portion 56 is locked to the locking portion 67F of each projection 66. In this way, the rubber plug 50 is positioned in the rubber plug holder 60 and is held retained in the rubber plug holder 60 by locking between the thick portions 56 and the locking portions 67F of the projections 66 even if the shaft portion 51 is pulled down.

Figure 16:
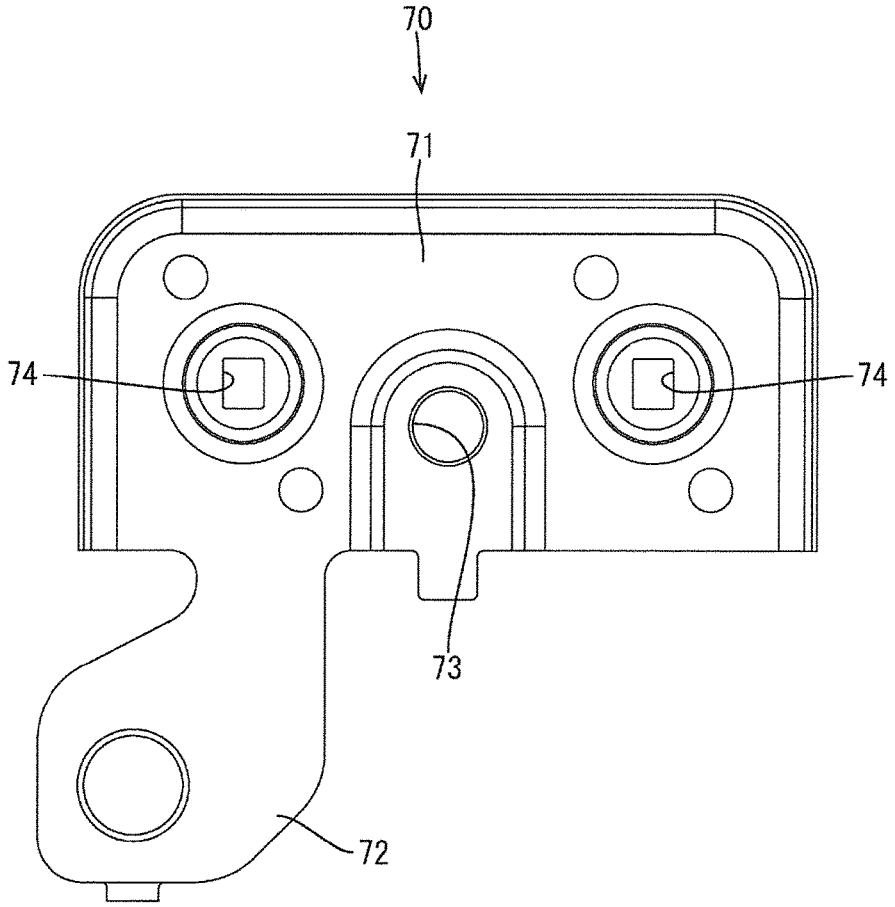
FIG. 16 is a plan view of a cover.

The cover 70 includes a cover body 71 having a laterally long and substantially rectangular shape. A connecting piece 72 protrudes outward from a peripheral edge of the cover body 71, as shown in FIG. 16. A bolt hole 73 through which the bolt 41 is to be inserted is open in a central part of the cover body 71. Further, two lock holes 74 are open at both sides of the bolt hole 73 in the cover body 71.

When the rubber plugs 50 are assembled with the rubber plug holders 60 and these assemblies are assembled with the cover 70, the pairs of lock pieces 62 are fit into the lock holes 74 and the respective lock projections 62A are locked to edges of the lock holes 74, as shown in FIG. 5. As a result, the rubber plug holders 60 are fixed to the cover 70 and the rubber plug assembly 40 is configured. The thin portions 55 of the legs 52 are in contact with parts surrounding the lock holes 74 from below. On the other hand, the thick portions 56 of the legs 52 are disposed between the rubber plug fixing portions 64 and the cover body 71 to surround the projections 66. In this way, the cover body 71 and the projections 66 prevent the thick portions 56 from being detached from the projections 66, and the through holes 53 are held in a fit state.

As described above, since recesses (through holes 53) of the legs 52 are long in a radial direction. Thus, the peripheral walls 54 of the recesses will not interfere with the projections 66 to obstruct returning movements of the legs 52 when the legs 52 return and the recesses are fit to the projections 66. Specifically, since the recesses can be fit to the projections 66 merely by the reaction force (force trying to return to the natural state) of the rubber plug 50, it is not necessary to fit the recesses to the projections 66 by forcibly deforming or pulling the legs 52 and assembling efficiency can be improved drastically.

A tapered portion (first tapered portion 67C, second tapered portion 67E) configured not to obstruct the returning movement of the leg 52 may be provided between the locking portion 67F of the projection 66 facing the inner wall (thick portion 56) of the recess and the assembling hole 65. According to this configuration, there is nothing that obstructs the returning movements of the legs 52 until the legs 52 contact the tapered portions after being inserted into the assembling holes 65, and the legs 52 are in an open state when contacting the tapered portions. Thus, the reaction force of the rubber plug 50 easily acts in a direction to assemble the rubber plug 50 with the rubber plug holder 60.

The projection 66 may be tapered by a plurality of tapered portions. According to this configuration, the projection 66 is fit easily fit into the recess.

The invention is not limited to the above described and illustrated embodiment. For example, the following various modes are also included.

Although the through hole 53 is illustrated as the recess in the leg 52 in the above embodiment, a bottomed recess may be provided.

The cover 70 is fixed to the housing 20 via the upper shell 31 in the above embodiment. However, the cover 70 may be fixed directly to the upper part of the housing 20.

The thin portion 55 is deformed resiliently in the above embodiment, the peripheral wall of the through hole 53 may be composed only of the thick portion 56 and a part of the thick portion 56 may be resiliently deformed.

Although both the first tapered portion 67C and the second tapered portion 67E are provided in the above embodiment, only one of them may be provided or no tapered portion may be provided.

The rubber plug holder 60 is fixed to the cover 70 by fitting the lock pieces 62 into the lock hole 75 in the above embodiment. However, a cover may be fixed to a rubber plug holder by a bolt.

The rubber plug 50 for waterproofing the voltage detection hole 23 is illustrated in the above embodiment. However, a hole for another purpose may be waterproofed by the rubber plug 50.

LIST OF REFERENCE SIGNS

20 . . . housing
40 . . . rubber plug assembly
50 . . . rubber plug
51 . . . shaft
51A . . . axial end part
52 . . . leg
53 . . . through hole (recess)
54 . . . peripheral wall
56 . . . thick portion (inner wall of recess)
60 . . . rubber plug holder
65 . . . assembling hole
66 . . . projection
67C . . . first tapered portion
67E . . . second tapered portion
67F . . . locking portion
70 . . . cover

The invention claimed is:

1. A rubber plug assembly, comprising:

a rubber plug including a shaft portion for waterproofing the interior of a housing and a leg portion extending outward in a radial direction from an end part of the shaft portion in an axial direction, a recess provided in the leg portion being shaped to be long in the radial direction;

a cover to be fixed to the housing; and a rubber plug holder including an assembling hole for allowing the leg portion oriented to extend in the axial direction to be inserted thereinto by resiliently deforming a part of the leg portion and a projection for positioning the rubber plug by being fit into the recess by a return of the leg portion having passed through the assembling hole, the projection and the recess being held in a fit state by fixing the rubber plug holder to the cover.

2. The rubber plug assembly of claim 1, wherein a tapered portion configured not to obstruct a returning movement of the leg portion is provided between a locking portion of the projection facing an inner wall of the recess and the assembling hole.

3. The rubber plug assembly of claim 2, wherein the projection is tapered by a plurality of the tapered portions.

* * * * *